US008615983B2

(12) United States Patent
Knafl et al.

(10) Patent No.: US 8,615,983 B2
(45) Date of Patent: Dec. 31, 2013

(54) HEAT EXCHANGER METHOD AND APPARATUS FOR ENGINE EXHAUST GAS RECIRCULATION SYSTEM

(75) Inventors: Alexander Knafl, Anacortes, WA (US); Patrick G. Szymkowicz, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 264 days.

(21) Appl. No.: 12/775,608

(22) Filed: May 7, 2010

(65) Prior Publication Data

US 2011/0271661 A1 Nov. 10, 2011

(51) Int. Cl.

| | |
|---|---|
| ***F01N 9/00*** | (2006.01) |
| ***F01N 3/035*** | (2006.01) |
| ***F01N 3/10*** | (2006.01) |
| ***F01N 3/023*** | (2006.01) |
| ***F01N 3/02*** | (2006.01) |
| ***F02M 25/07*** | (2006.01) |

(52) U.S. Cl.
USPC ..... 60/278; 60/274; 60/295; 60/297; 60/311

(58) Field of Classification Search
USPC ..... 60/274, 278, 297, 311, 295
See application file for complete search history.

(56) References Cited

U.S. PATENT DOCUMENTS

| | | | | |
|---|---|---|---|---|
| 5,671,600 | A * | 9/1997 | Pischinger et al. | 60/605.2 |
| 5,771,868 | A * | 6/1998 | Khair | 123/568.12 |
| 5,802,846 | A * | 9/1998 | Bailey | 60/278 |
| 7,043,914 | B2 * | 5/2006 | Ishikawa | 60/605.2 |
| 7,461,639 | B2 | 12/2008 | Jehlik | |
| 7,461,641 | B1 | 12/2008 | Styles et al. | |
| 2004/0031262 | A1 * | 2/2004 | Gui et al. | 60/285 |
| 2004/0050373 | A1 * | 3/2004 | Gao et al. | 123/568.12 |
| 2005/0056017 | A1 * | 3/2005 | Sisken et al. | 60/605.2 |
| 2005/0103013 | A1 * | 5/2005 | Brookshire et al. | 60/605.2 |
| 2006/0021335 | A1 * | 2/2006 | Opris | 60/297 |
| 2006/0245985 | A1 * | 11/2006 | Harada et al. | 422/177 |
| 2006/0266019 | A1 * | 11/2006 | Ricart-Ugaz | 60/278 |

FOREIGN PATENT DOCUMENTS

| | | | |
|---|---|---|---|
| DE | 4439940 | A1 | 5/1996 |
| DE | 10348366 | B4 | 6/2007 |

OTHER PUBLICATIONS

Allansson, Ronny; Optimising the Low Temperature Performance and Regeneration Efficiency of the Continuously Regenerating Diesel Particulate Filter (CR-DPF) System; SAE 2002-01-0428; SAE Technical Paper Series; 2002.

* cited by examiner

*Primary Examiner* — Thomas Denion
*Assistant Examiner* — Brandon Lee

(57) ABSTRACT

A method for operating an internal combustion engine configured to operate lean of stoichiometry includes reducing temperature of a portion of an exhaust gas feedstream recirculated to an intake system of the engine, and reducing mass flowrate of particulate matter and hydrocarbons borne in the recirculated portion of the exhaust gas feedstream upstream of the heat exchanger effective to reduce deposition of particulate matter and hydrocarbons onto and adhesion to surface areas of the heat exchanger.

6 Claims, 3 Drawing Sheets

HEAT EXCHANGER METHOD AND APPARATUS FOR ENGINE EXHAUST GAS RECIRCULATION SYSTEM

TECHNICAL FIELD

This disclosure relates to internal combustion engines, and more particularly to heat exchangers exposed to an exhaust gas feedstream of an internal combustion engine.

BACKGROUND

The statements in this section merely provide background information related to the present disclosure and may not constitute prior art.

Internal combustion engines generate exhaust gas, including hydrocarbon (HC), carbon monoxide (CO), oxides of nitrogen (NOx), particulate matter (PM) and other emissions gases. An exhaust gas recirculation (EGR) system can be employed to reduce oxides of nitrogen (NOx) by diluting incoming air with recirculated exhaust gases which are inert, thus reducing peak combustion temperatures and correspondingly reducing NOx levels.

Combustion temperatures can be further reduced by cooling the recirculated exhaust gas, resulting in higher density recirculated exhaust gas. An EGR system can include a heat exchanger that cools the recirculating exhaust gas prior to entrance into the intake manifold. An EGR valve or other metering device may regulate the flow of the exhaust gas into the intake manifold.

A heat exchanger for use with an EGR system includes a plurality of heat exchange conduits constructed from thermally conductive material through which recirculating exhaust gas flows. The heat exchange conduits are in contact with a fluid, e.g., engine coolant or air that absorbs heat from the exhaust gas through the heat exchange conduit walls. Thermal efficiency, i.e., heat transfer through the heat exchange conduit walls may be reduced when hydrocarbons and soot including ash and particulate matter (PM) precipitates, coagulates and otherwise deposits onto and adheres to the walls of the heat exchange conduits.

Design of a heat exchanger for an EGR system can include compensating for loss of thermal efficiency during its service life, including sizing the heat exchanger with excess heat transfer capacity to compensate for fouling that can occur during its service life. This excess heat transfer capacity can consume available packaging space, add weight, and affect overall design of the heat exchanger.

SUMMARY

A method for operating an internal combustion engine configured to operate lean of stoichiometry includes reducing temperature of a portion of an exhaust gas feedstream recirculated to an intake system of the engine, and reducing mass flowrate of particulate matter and hydrocarbons borne in the recirculated portion of the exhaust gas feedstream upstream of the heat exchanger effective to reduce deposition of particulate matter and hydrocarbons onto and adhesion to surface areas of the heat exchanger.

BRIEF DESCRIPTION OF THE DRAWINGS

One or more embodiments will now be described, by way of example, with reference to the accompanying drawings, in which.

DETAILED DESCRIPTION

Figure 1:
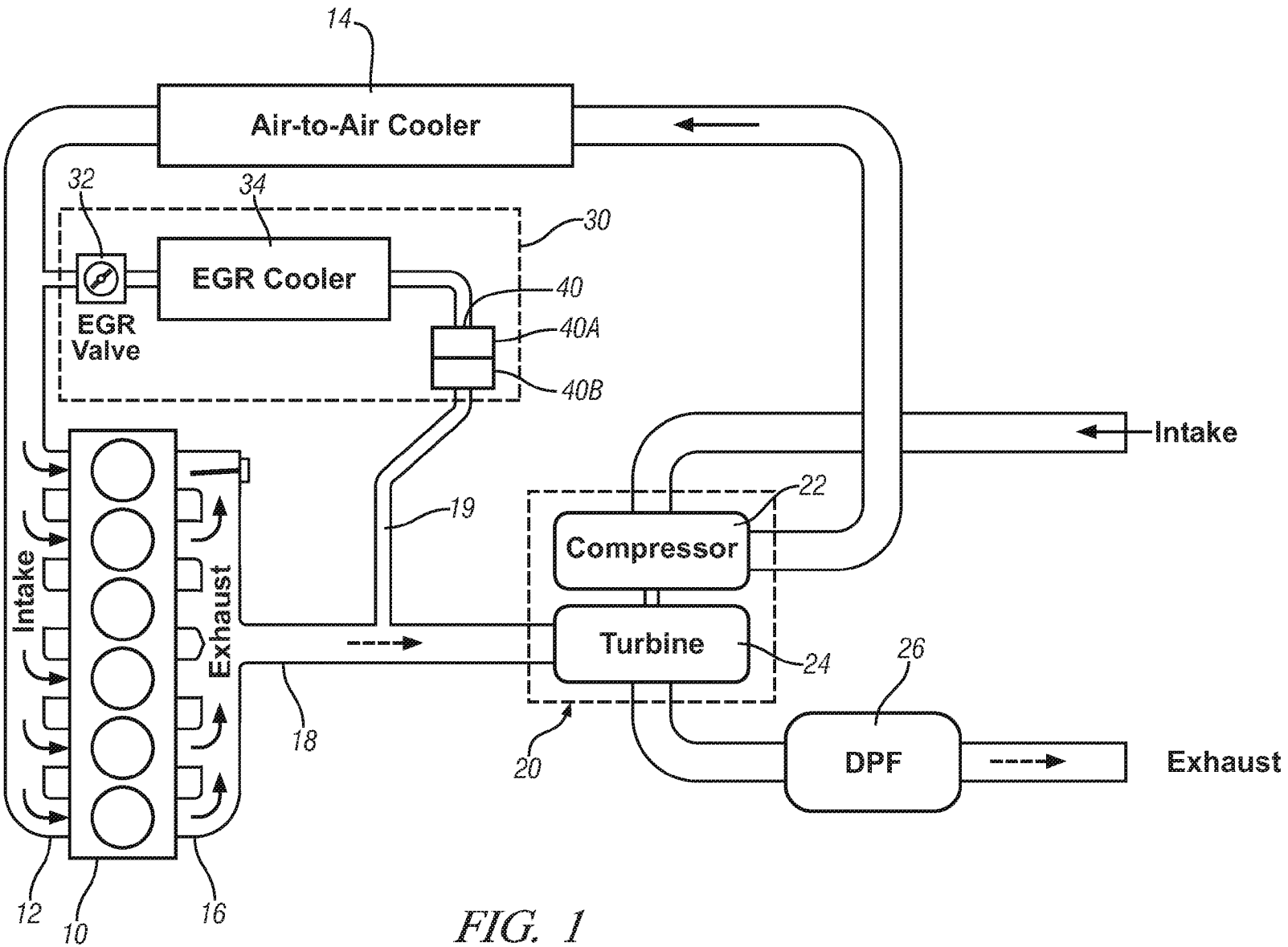
FIG. 1 is a two-dimensional schematic diagram of an engine system including an internal combustion engine, a turbocharger and an exhaust system in accordance with the present disclosure.

Referring now to the drawings, wherein the showings are for the purpose of illustrating certain exemplary embodiments only and not for the purpose of limiting the same, FIG. 1 illustrates an engine system including an internal combustion engine 10 including a turbocharger 20. The engine 10 is preferably configured to operate lean of stoichiometry. The engine includes an air intake system 12 and an exhaust system. The air intake system 12 includes, e.g., an intake manifold, an EGR inlet, and an air-to-air heat exchange device 14 configured to cool intake air downstream of a compressor section 22 of the turbocharger 20. The exhaust system entrains exhaust gas output from the engine 10 and includes, e.g., an exhaust manifold 16, a downpipe 18, an EGR conduit 19, an exhaust gas recirculation (EGR) system 30. Exhaust gas from the engine 10 flows into the exhaust manifold 16 through the downpipe 18 to a turbine section 24 of the turbocharger 20 and preferably passes through at least one exhaust aftertreatment device 26 prior to expulsion into atmospheric air.

The EGR conduit 19 directs a portion of the exhaust gas into the EGR system 30. In one embodiment, untreated exhaust gas flows from the engine 10 into the exhaust manifold 16 through the downpipe 18 with a portion of the exhaust gas flowing into the EGR conduit 19 to be recirculated into the intake system 12.

The EGR system 30 includes an EGR valve 32 downstream of a heat exchanger 34, as shown. Alternatively, the EGR valve 32 can be upstream of the heat exchanger 34. The heat exchanger 34 is downstream of an exhaust gas treatment device 40. The exhaust gas treatment device 40 includes first and second exhaust gas treatment devices 40A and 40B, respectively, configured to reduce deposition of particulate matter and hydrocarbons onto and adhesion to surface areas of the heat exchanger 34 to maintain thermal efficiency of the heat exchanger 34 and minimize loss of thermal efficiency.

The first exhaust gas treatment device 40A of the embodiment includes a catalyzed continuously regenerating particulate filter device, and is described with reference to FIG. 3, below. The second exhaust gas treatment device 40B is preferably an oxidation catalytic converter including a coating substrate configured to oxidize hydrocarbons in the recirculated portion of the exhaust gas feedstream upstream of the heat exchanger 34. The first and second exhaust gas treatment devices 40A and 40B are configured to prevent degradation of thermal efficiency of the heat exchanger 34 by removing thermally insulative materials from the recirculated portion of the exhaust gas feedstream upstream of the heat exchanger 34. By removing the thermally insulative materials, e.g., particulate matter and hydrocarbons from the recirculated portion of the exhaust gas feedstream upstream of the heat exchanger 34, deposition and precipitation of particulate matter in the exhaust gas onto surface areas 50A of the heat exchanger 34 is retarded.

The EGR system 30 recirculates a portion of the exhaust gas to the intake system 12 of the engine 10, with the mass flowrate controlled by the EGR valve 32 in conjunction with engine operating conditions. The EGR system 30 as shown in FIG. 1 is configured as a high-pressure loop EGR system with the EGR conduit 19 fluidly connected to the downpipe 18 and upstream of the turbine section 24 of the turbocharger 20. Alternatively, the EGR system 30 can be configured as a low-pressure loop EGR system including an EGR conduit fluidly connected to the exhaust system downstream of the turbine section 24 of the turbocharger 20.

A control module controls opening and closing of the EGR valve 32 during engine operation to meter, i.e., control the mass flowrate of the recirculated portion of the exhaust gas into the intake system 12. The heat exchanger 34 is configured to transfer heat between the recirculated portion of the exhaust gas and a second fluid across the heat exchanger 34 and includes a plurality of cylindrical tubes encased in a housing in one embodiment. The cylindrical tubes of the heat exchanger 34 are formed from thermally conductive material, e.g., aluminum or stainless steel. A person having ordinary skill in the art will appreciate that the heat exchanger 34 may include any one of various heat exchanger configurations. For example, the heat exchanger 34 may include a tube-type, plate-type, shell-type, or other heat exchanger configurations using parallel-flow and counter-flow heat transfer methods.

Figure 2A:
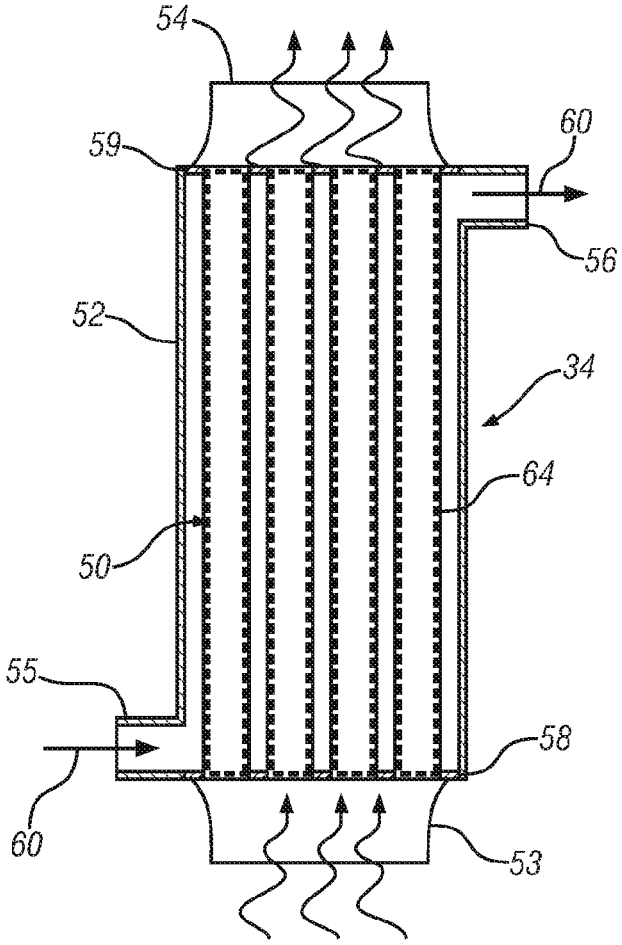
FIGS. 2A and 2B are two-dimensional schematic views including a side-view and an end-view of an axial-flow tube-type heat exchanger device in accordance with the present disclosure.
Figure 2B:
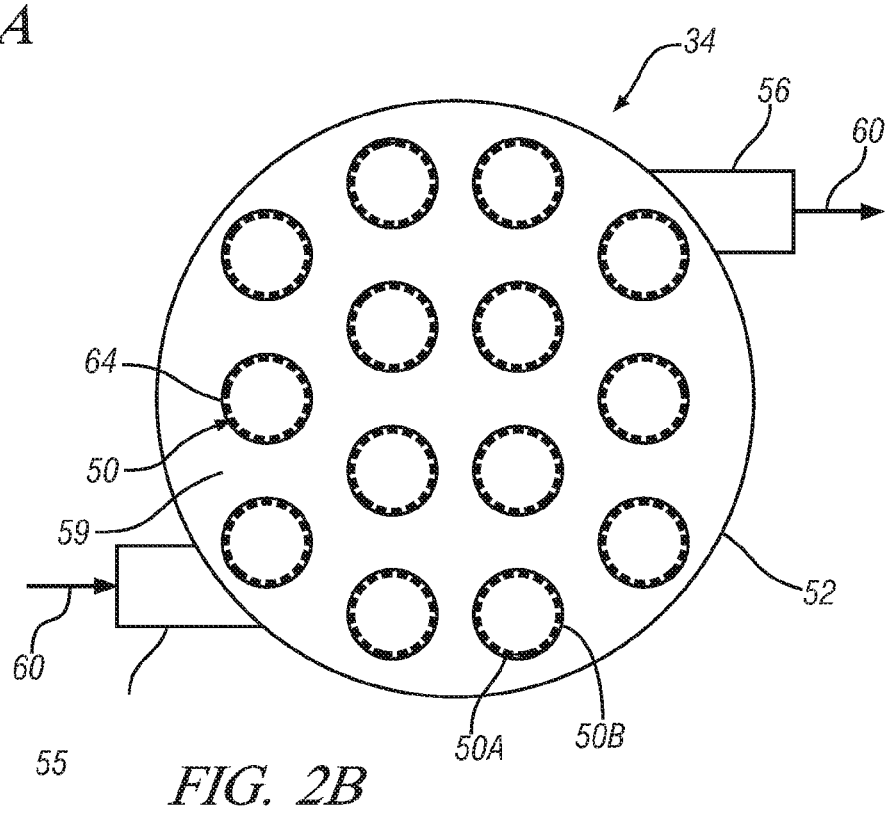

FIGS. 2A and 2B schematically show a side-view and an end-view of an exemplary embodiment of the heat exchanger 34, including an axial-flow tube-type heat exchanger including a plurality of heat exchange devices including cylindrical tubes 50 that function as fluidic conduits. The tubes 50 are located in a housing 52. The tubes 50 are made from thermally conductive material. Each tube 50 has an inner surface 50A and an outer surface 50B. An exhaust gas path is formed through the heat exchanger 34 including an exhaust gas inlet 53 that is fluidly connected to the inner surface 50A of the tubes 50 that is fluidly connected to an exhaust gas outlet 54. The exhaust gas inlet 53 and the exhaust gas outlet 54 are preferably located at opposite ends of the heat exchanger 34. The tubes 50 are fluidly connected in a parallel arrangement resulting in concurrent fluidic flow of the recirculated portion of the exhaust gas through the inner surfaces 50A of all the tubes 50. Alternatively, the tubes 50 can be fluidly connected in a series arrangement resulting in serial fluidic flow of the recirculated portion of the exhaust gas through the inner surfaces 50A of the tubes 50. The housing 52 also includes second fluid path including a second fluid inlet 55 and a second fluid outlet 56. An inlet plate 58 and outlet plate 59 may be positioned between the exhaust inlet opening 53 and housing 52 and between the housing 52 and the exhaust outlet opening 54, respectively. The second fluid inlet 55 and the second fluid outlet 56 are connected to a second fluid circulation system. The second fluid inlet 55 and second fluid outlet 56 define the second fluid path through the cylindrical housing 52 for the second fluid 60.

The recirculated portion of the exhaust gas flows through the exhaust gas path entering the heat exchanger 34 through the exhaust gas inlet 53, flowing through the plurality of tubes 50 in fluidic contact with the inner surfaces 50A thereof and exiting through the exhaust gas outlet 54.

The second fluid 60, e.g., ambient air or engine coolant, flows through the second fluid path contained within the housing 52 and fluidly contacts the outer surfaces 50B of the plurality of tubes 50. More specifically, the second fluid 60 enters the second fluid inlet 55, fluidly contacts the outer surfaces 50B of the tubes 50, and exits through the second fluid outlet 56. The inlet and outlet plates 58 and 59 contain the second fluid 60 within the housing 52. Heat is exchanged across the inner surfaces 50A and outer surfaces 50B of the plurality of tubes 50 between the recirculated portion of the exhaust gas and the second fluid 60.

In one embodiment, direction of flow of the recirculated portion of the exhaust gas is parallel to the direction of flow of the second fluid 60. In one embodiment, direction of flow of the recirculated portion of the exhaust gas is counter to the direction of flow of the second fluid 60.

Heat transfer through the heat exchanger 34 is a function of the temperature differential between the recirculated portion of the exhaust gas and the associated second fluid 60 between the inner and outer surfaces 50A and 50B, and the thermal efficiency of the heat exchange tubes 50.

The thermal efficiency of the heat exchange tubes 50 is affected by presence of insulative materials deposited thereon. The insulative materials can include particulate matter (PM) including ash and soot, and unburned hydrocarbons. The insulative materials condense, precipitate, coagulate and otherwise deposit onto and adhere to the inner surface 50A of the heat exchange conduits 50. The thermal efficiency of the heat exchange tubes 50 reduces with an increased thickness of the insulative materials. The unburned hydrocarbons, particulate matter, and ash resulting from combustion are present in the exhaust gas feedstream in varying concentrations depending upon engine operating factors and ambient conditions. Magnitude of deposition of the insulative materials on the inner surfaces 50A of the heat exchanger 34 can be associated with factors including EGR mass flowrate and velocity, temperature and temperature gradient of the recirculated portion of the exhaust gas, and surface geometry of the inner surfaces 50A of the heat exchanger 34.

Figure 3:
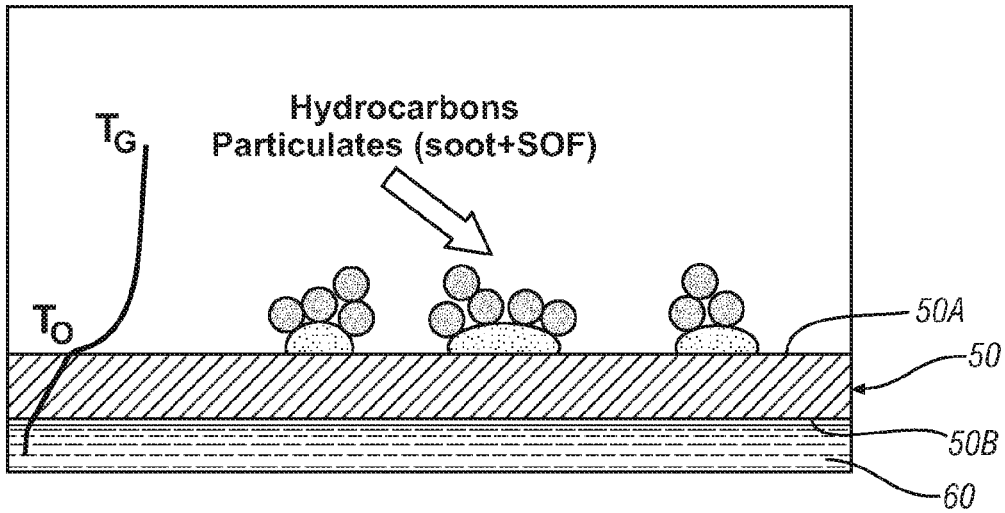
FIG. 3 is a schematic view of surface deposition of particulate matter and hydrocarbons onto an inner surface of a heat exchanger in accordance with the present disclosure.

FIG. 3 schematically shows an inner surface 50A of an exemplary heat exchanger 34 and depicts deposition of particulate matter and hydrocarbons thereon. A temperature gradient is superimposed and graphically depicted by a line showing exhaust gas temperature $T_G$ and surface temperature $T_O$. The temperature gradient indicates an increasing temperature from the coolant through the outer surface 50B and inner surface 50A of the heat exchanger walls 50 to the center portion of the exhaust gas flow. Operating conditions that promote fouling or deposition of particulate matter and hydrocarbons include a high concentration of particulate matter in the exhaust gas feedstream at the exhaust gas inlet 53 to the heat exchanger 34, a high temperature gradient of the exhaust gas feedstream from the exhaust gas inlet 53 to the exhaust gas outlet 54, a low temperature of the exhaust gas feedstream at the exhaust gas outlet 54 promoting condensation within the heat exchanger 34, and wet particles within the exhaust gas feedstream. Fouling can be exacerbated by intermittent operation of the engine 10, which increases opportunities for exhaust gas to contact and condense on low temperature surfaces.

The thermal efficiency of the heat exchange tubes 50 can be maintained, and loss of thermal efficiency of the heat exchange tubes 50 can be reduced or eliminated by reducing and eliminating deposition of the insulative materials on the inner surfaces 50A of the heat exchanger 34. This reducing and eliminating deposition of the insulative materials on the inner surfaces 50A of the heat exchanger 34 can be accomplished by filtering and otherwise eliminating particulate matter resulting from combustion from the portion of the exhaust gas feedstream flowing through the EGR system 30 and trapping and oxidizing the unburned hydrocarbons.

Figure 4:
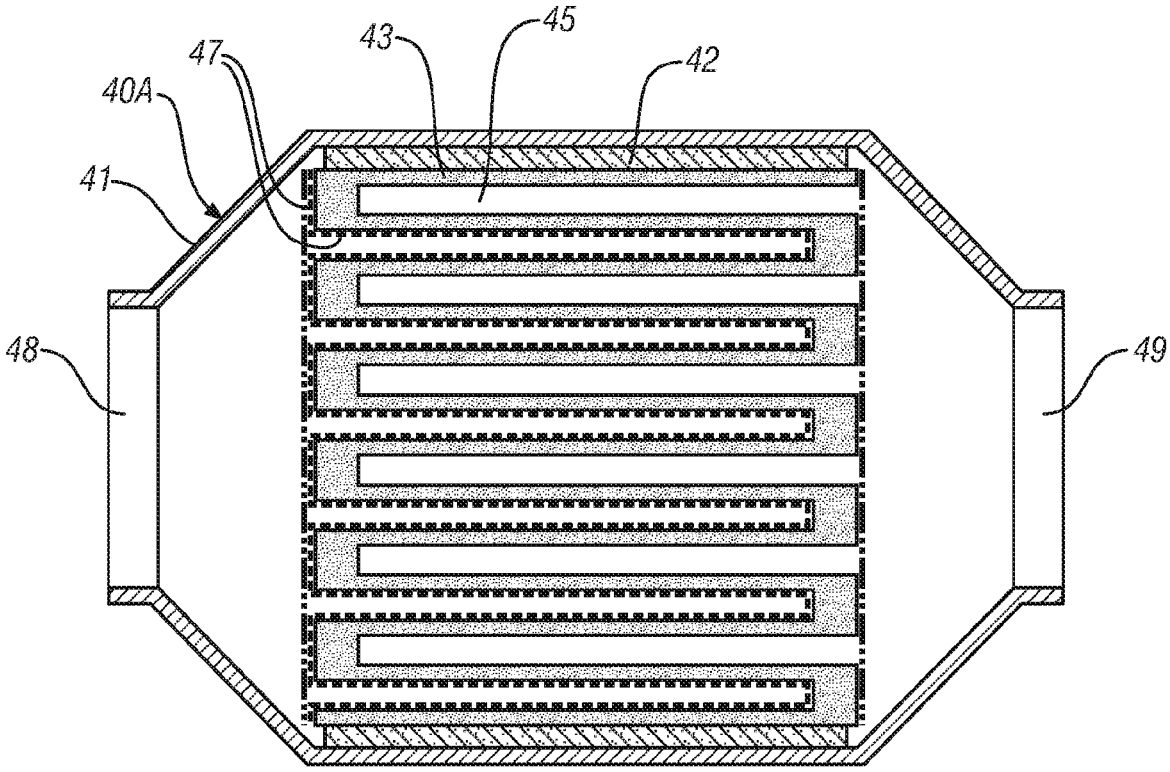
FIG. 4 is a two-dimensional schematic diagram of a first exhaust gas treatment device including a catalyzed continuously regenerating particulate filter device in accordance with the present disclosure.

FIG. 4 schematically shows in two-dimensional detail an embodiment of the first exhaust gas treatment device 40A, including a catalyzed continuously regenerating particulate filter device including a wall-flow type filter substrate 43 configured to reduce mass flowrate of the particulate matter that is borne in the recirculated portion of the exhaust gas feedstream upstream of the heat exchanger 34. The particulate filter assembly 40A includes a metallic container 41 having an inlet 48 and an outlet 49 that provides a structural housing for the filter substrate 43. Insulative support material 42 wraps around the filter substrate 43 and mechanically supports and secures the filter substrate 43 within the metallic container 41. The filter substrate 43 is coated with a catalyzed washcoat material 47, shown as applied on the inlet side of the filter substrate 43 in one embodiment. Preferred washcoat materials can include an alumina-based washcoat including catalytic metals, e.g., platinum, palladium, rhodium, and cerium.

The filter substrate 43 preferably includes a monolith device having a honeycomb structure formed from ceramic including extruded SiC or cordierite. The filter substrate 43 includes a multiplicity of parallel flow passages 45 formed parallel to a longitudinal flow axis between the inlet 48 and the outlet 49. Walls of the filter substrate 43 formed between the flow passages 45 by the extruded cordierite are porous. The flow passages 45 are alternately closed at an end of the filter substrate 43 facing the inlet 48 and at an end of the filter substrate 43 facing the outlet 49 in a checkerboard fashion. The alternately closed flow passages 45 cause the exhaust gas feedstream to flow through the porous walls of the filter substrate 43 as exhaust gas flows from the inlet 48 to the outlet 49 due to the pressure differential in the exhaust gas feedstream between the inlet 48 and the outlet 49 during engine operation.

Flow of the exhaust gas feedstream through the porous walls of the filter substrate 43 serves to filter or strip particulate matter out of the exhaust gas feedstream and bring the exhaust gas feedstream in close proximity to the catalyst material applied to the substrate. The catalyst such as platinum (Pt), and an oxygen storage material such as Ceria ($CeO_2$), may be applied to the substrate by impregnation using a water-based solution or by a washcoat with suspensions of insoluble oxides or salts. The catalyst functions at lower exhaust gas temperatures to continuously oxidize the particulate matter as it is trapped in the filter substrate 43 using $NO_2$ contained in the exhaust gas feedstream. Preferably the exhaust gas treatment device 40A has a pressure drop less than 5 kPa under operating conditions including an EGR flowrate of 40%. Alternatively, a flow-through particulate filter can be used. A flow-through filter uses a plurality of thin metal foil devices that are designed to target flow of the exhaust gas and cause particulate matter to decelerate and deposit onto an inner surface without permeating a wall.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A method for operating an internal combustion engine configured to operate lean of stoichiometry, comprising:

employing an exhaust gas recirculation system configured as a high-pressure loop system including a conduit fluidly connected to a downpipe of the engine upstream of a turbine section of a turbocharger to recirculate a portion of an exhaust gas feedstream of the engine, said exhaust gas recirculation system including an exhaust gas treatment device comprising:

a particulate filter device fluidly coupled to a heat exchanger fluidly coupled to an intake system of the engine downstream of a compressor section of the turbocharger, the particulate filter device configured to filter particulate matter in the exhaust gas feedstream utilizing a filter substrate, and continuously regenerate the filter substrate utilizing an oxidation catalyst coated on the filter substrate, the oxidation catalyst enabling the particulate matter to continuously oxidize at lower exhaust gas feedstream temperatures;

a hydrocarbon trap device fluidly coupled to the particulate filter device, the hydrocarbon trap configured to trap unburned hydrocarbons within the exhaust gas feedstream, and oxidize the unburned hydrocarbons utilizing a substrate coated on the hydrocarbon trap device;

reducing temperature of the portion of the exhaust gas feedstream recirculated to the intake system of the engine; and reducing mass flowrate of particulate matter and hydrocarbons borne in the recirculated portion of the exhaust gas feedstream upstream of the heat exchanger to reduce deposition of particulate matter and hydrocarbons onto and adhesion to surface areas of the heat exchanger.

2. The method of claim 1, wherein reducing mass flowrate of hydrocarbons borne in the recirculated portion of the exhaust gas feedstream upstream of the heat exchanger comprises passing the recirculated portion of the exhaust gas feedstream through the hydrocarbon trap device that is upstream of the heat exchanger.

3. The method of claim 2, wherein reducing mass flowrate of particulate matter in the recirculated portion of the exhaust gas feedstream upstream of the heat exchanger comprises passing the recirculated portion of the exhaust gas feedstream through the particulate filter device that is downstream of the hydrocarbon trap device and upstream of the heat exchanger.

4. The method of claim 1, wherein reducing mass flowrate of particulate matter in the recirculated portion of the exhaust gas feedstream upstream of the heat exchanger comprises passing the recirculated portion of the exhaust gas feedstream through the particulate filter device that is upstream of the heat exchanger.

5. An exhaust gas recirculation system for an internal combustion engine configured to operate lean of stoichiometry, comprising:

the exhaust gas recirculation system configured as a high-pressure loop system including a conduit fluidly connected to a downpipe of the engine upstream of a turbine section of a turbocharger and comprising:

particulate filter device fluidly coupled to a heat exchanger fluidly coupled to an intake system of the engine downstream of a compressor section of the turbocharger, the particulate filter device configured to filter particulate matter in the exhaust gas feedstream utilizing a filter substrate, and continuously regenerate the filter substrate utilizing an oxidation catalyst coated on the filter substrate, the oxidation catalyst enabling the particulate matter to continuously oxidize at lower exhaust gas feedstream temperatures;

a hydrocarbon trap device fluidly coupled to the particulate filter device, the hydrocarbon trap configured to trap unburned hydrocarbons within the exhaust gas feedstream, and oxidize the unburned hydrocarbons utilizing a substrate coated on the hydrocarbon trap device;

the heat exchanger configured to reduce temperature of a portion of an exhaust gas feedstream that is recirculated to the intake system of the engine, and the hydrocarbon trap device and the particulate filter device located upstream of the heat exchanger and fluidly coupled to said conduit fluidly connected to the downpipe of the engine to reduce mass flowrate of particulate matter and hydrocarbons borne in the recirculated portion of the exhaust gas feedstream and to reduce deposition of particulate matter and hydrocarbons onto and adhesion to surface areas of the heat exchanger.

6. The exhaust gas recirculation system of claim 5, wherein the particulate filter device is located downstream of the hydrocarbon trap device and upstream of the heat exchanger.

* * * * *